US005109769A

United States Patent [19]

Wright, Jr.

[11] Patent Number: 5,109,769

[45] Date of Patent: May 5, 1992

[54] INKING APPARATUS FOR PRINTING ON NON POROUS SURFACES

[75] Inventor: Donald C. Wright, Jr., St. Petersburg, Fla.

[73] Assignee: Universal Fountain Brush Co., St. Petersburg, Fla.

[21] Appl. No.: 684,669

[22] Filed: Apr. 12, 1991

[51] Int. Cl.[5] ..... B41F 5/00

[52] U.S. Cl. ..... 101/329; 101/206; 101/349

[58] Field of Search ..... 101/103, 109, 36, 35, 101/37, 327, 328, 329, 330, 331, 213, 205, 206, 363, 364, 349

[56] References Cited

U.S. PATENT DOCUMENTS

| | | | |
|---|---|---|---|
| 321,223 | 6/1885 | Keeler | 101/213 |
| 1,025,137 | 5/1912 | Hesson | 101/213 |
| 1,864,411 | 6/1932 | Crotty | 101/329 |
| 2,963,962 | 12/1960 | Worth | 101/35 |
| 3,021,783 | 2/1962 | Casey | 101/329 |
| 3,662,682 | 5/1972 | Marozzi | 101/330 |
| 3,785,288 | 1/1974 | Hunter | 101/348 |
| 3,901,150 | 8/1975 | Kirby, Jr. | 101/363 |
| 4,051,781 | 10/1977 | Nishikawa | 101/348 |
| 4,152,980 | 5/1979 | Siegal | 101/329 |
| 4,440,083 | 4/1984 | Hooper | 101/103 |
| 4,478,146 | 10/1984 | Mistyurik | 101/205 |
| 4,566,382 | 1/1986 | Bronson et al. | 101/331 |
| 4,699,054 | 10/1987 | Scindato et al. | 101/330 |
| 4,860,648 | 8/1989 | Beaver et al. | 101/35 |
| 4,969,394 | 11/1990 | Didsun et al. | 101/330 |

FOREIGN PATENT DOCUMENTS

| | | | |
|---|---|---|---|
| 22080 | 2/1982 | Japan | 101/110 |

OTHER PUBLICATIONS

Model 400 Universal Conveyer Line Printer.
Model HP200 Universal Hand Printer.
Model MC20 Universal Mini-Coder.

*Primary Examiner*—Edgar S. Burr
*Assistant Examiner*—Ren Yan
*Attorney, Agent, or Firm*—Herbert W. Larson

[57] ABSTRACT

A cartridge housing is provided for a transfer roll and an abutting ink roll. The housing inner wall is spaced closely around the transfer roll with a discontinuity in an exterior side wall that is only sufficiently wide to permit less than 90 degrees of the transfer roll outer circumference to be exposed at any one time. The exposed portion of the transfer roll abuts a print surface on a print drum. A like discontinuity in the inner housing wall around the transfer roll at a point distal from the exterior wall discontinuity permits contact with an eccentrically mounted rotatable ink roll which supplies a continuous amount of ink to the transfer roll as the transfer roll turns.

22 Claims, 6 Drawing Sheets

INKING APPARATUS FOR PRINTING ON NON POROUS SURFACES

BACKGROUND OF THE INVENTION

1. Field of The Invention

This invention relates to cartridges containing ink rolls for fast drying inks. More particularly, it relates to protective cartridge housings for preventing ink rolls from drying out after contact with quick drying inks.

2. Description of The Prior Art

Cartridge structures for ink rolls used for inking type characters on a box or other print receiving member are known as described in U. S. Pat. No. 3,785,288. In addition, ink cartridges are sold commercially for use in conveyor line printers such as Model 100 manufactured by Universal Fountain Brush Co. These cartridges are useful to print on all types of surfaces. However, a problem has occurred in attempts to use the required high volatile inks needed to print on non-porous surfaces such as waxed boxes, plastic films and metalized surfaces. The problem is the drying out of the ink rolls caused by the high volatile inks. After standing overnight, the ink roll becomes hard and brittle and in this condition will not transfer ink to the print surface. This necessitates frequent replacement of the ink roll and added expense to the manufacturers. An improved cartridge is needed which will prevent the drying out of ink rolls used with high volatile inks.

SUMMARY OF THE INVENTION

I have invented a cartridge housing which retains volatile inks within the housing, prevents the drying out of ink rolls and consequently extends the useful life of the ink rolls.

My cartridge has a closely fitted top and bottom housing. The top housing has an inner wall spaced closely around the ink roll and the transfer roll with a discontinuity in an exterior side wall that is only sufficiently wide to permit less than 90 degrees of the transfer roll outer circumference to be exposed at any one time and the exposed portion of the transfer roll abuts a print die surface on a print drum. A like discontinuity in an inner wall of the top housing around the transfer roll at a point distal from the exterior wall discontinuity permits contact with an eccentrically mounted ink roll which supplies a continuous amount of ink to the transfer roll as the transfer roll turns. The transfer roll turns by a direct drive from a drive roll frictionally moved by a surface of the print drum moving in response to contact with a printing surface. The printing surface is usually on a box moving on a conveyor past the print drum, a continuous web of plastic film or metal foil.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
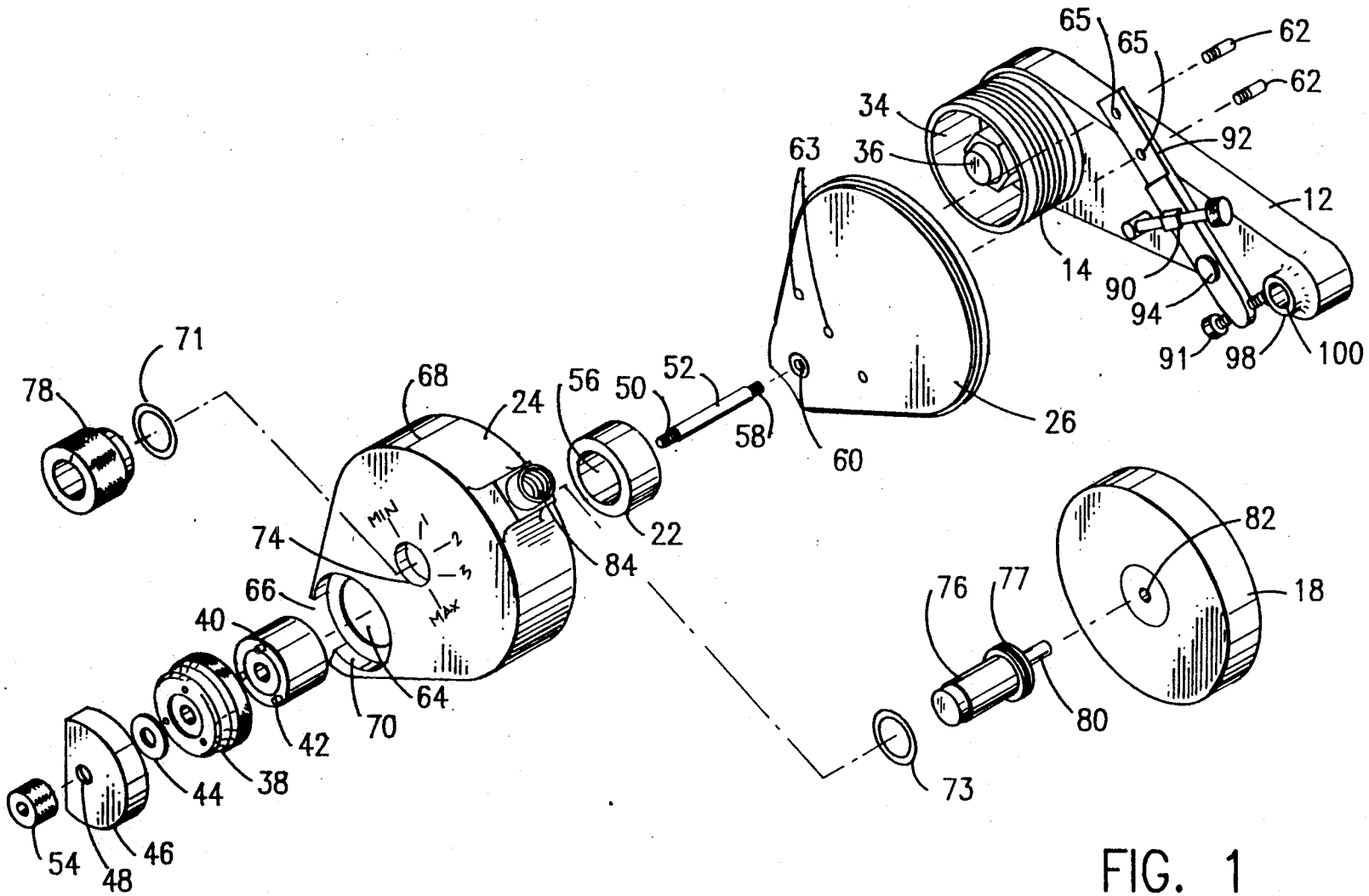
FIG. 1 is an exploded view of the inking roll, transfer roll, print drum and protective cartridge housing.

Throughout the following detailed description, the same reference numerals refer to the same elements in all FIGS.

Figure 3:
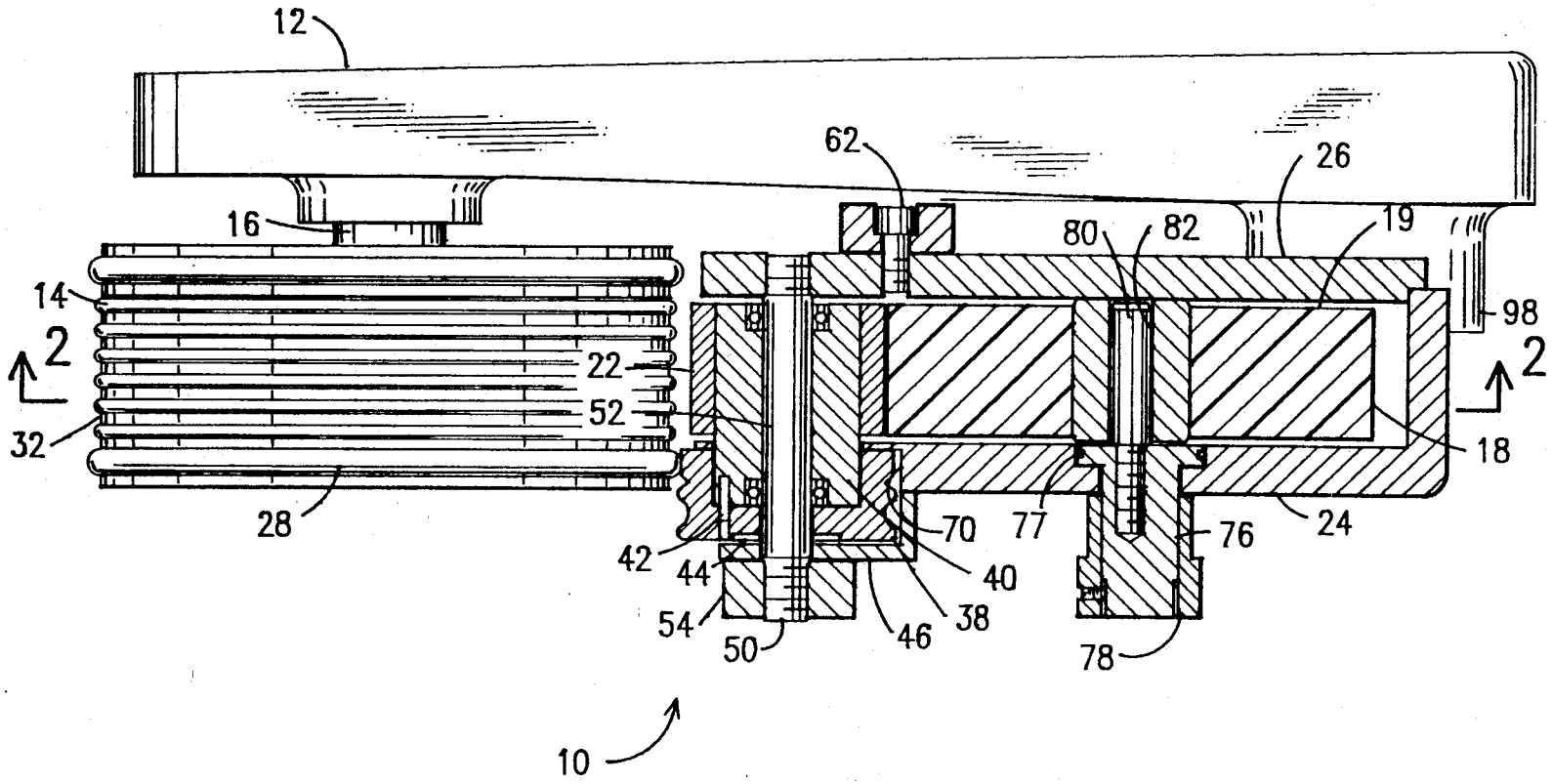
FIG. 3 is a side elevation cross-sectional view of the inking roll, transfer roll, print drum and protective cartridge housing.

The inking apparatus 10 of this invention shown in section in FIG. 3 has a mounting base 12, a print drum 14 rotatable on a shaft 16 supported by the base 12, an ink roll 18 rotatable on a shaft 80, an ink transfer roll 22 and a closely fitted top ink housing 24 and bottom ink housing 26 enclosing the ink roll 18 and transfer roll 22.

Figure 2:
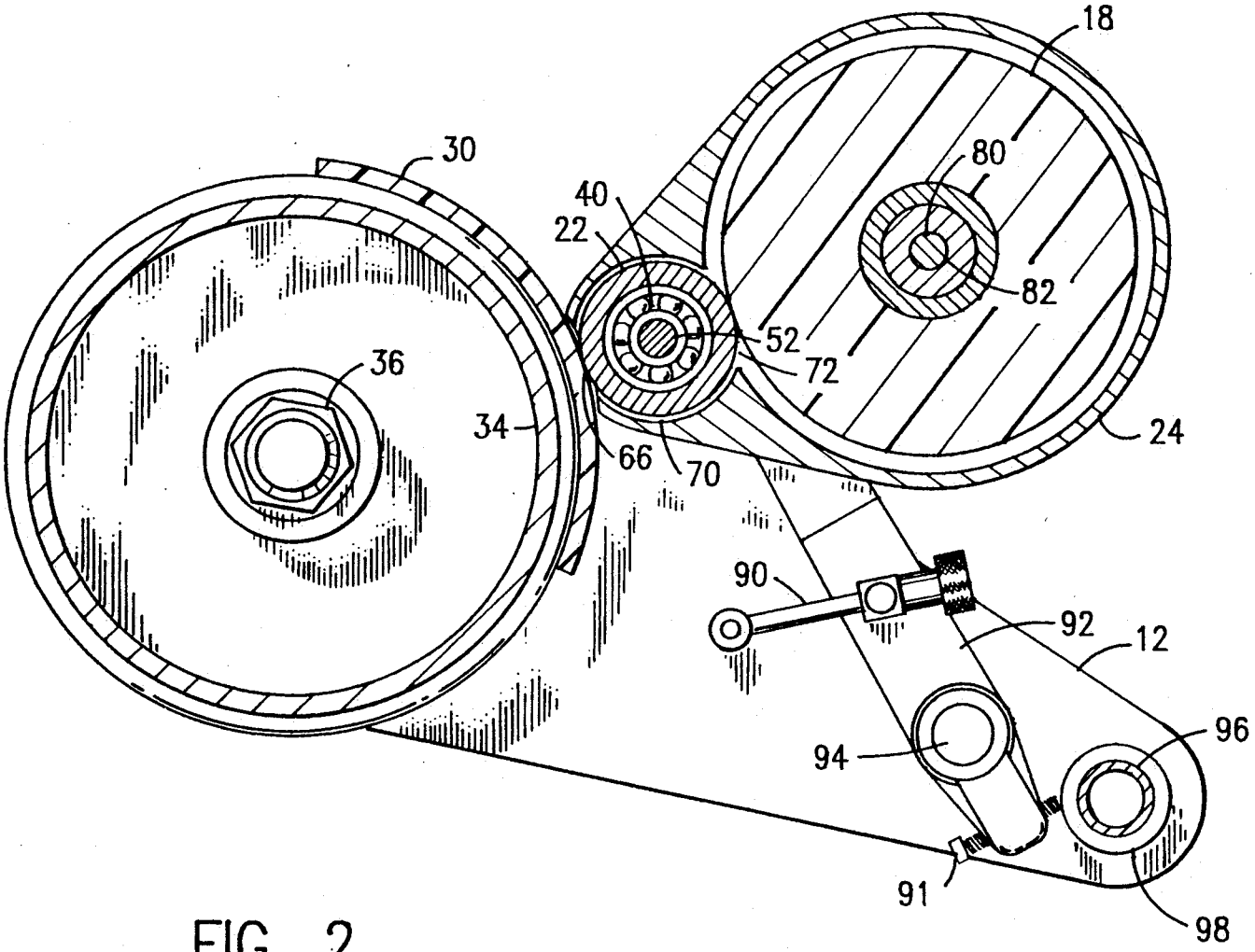
FIG. 2 is a transverse cross-sectional view along lines 2—2 of FIG. 3.

The print drum 14 has a rubberized rail 28 around a top portion. The rail 28 engages a drive roll 38 and turns the drive roll as the drum 14 turns in response to frictional engagement to a moving print surface (not shown). Print die letters 30 seen in FIG. 2, are press fit into grooves 32 on the print drum 14. The transfer roll 22 coats the letters 30 with ink to make an impression on the required print surface. The print drum 14 has an interior annular wall 34 and spaced apart from the wall 14 is nut 36 on shaft 16 to hold the print drum 14 in position on base 12.

The rubberized rail 28 of the print drum 14 turning drive roll 38 is seen in FIG. 3. A ball bearing hub 40 located below the drive roll 38 has three upwardly projecting pins 42 engaging with a bottom surface of the drive roll 38 as seen in FIG. 1. A washer 44 and a cover 46 are inserted over the drive roll 38. A bore 48 through cover 46 receives the top threads 50 from a stud 52 and a knurled knob 54 engages the threads 50 to tighten the drive assembly through the central opening 56 in the transfer roll 22. The bottom threads 58 engage threads within a bore 60 in the back housing 26. The back housing 26 is held in place over the mounting base 12 on arm 92 by allen screws 62 engaging threads within bores 63. The threads on allen screws 62 pass through bore 65 on arm 92.

Top housing 24 has three bores. The first 64, receives the ball bearing hub 40 connected to transfer roll 22 within housing 24. A small discontinuity 66 in side wall 68 provides a restricted opening for a small portion of transfer roll 22 to be exposed to the letters 30 on the print drum 14 as the drum moves past the transfer roll 22. As seen in FIG. 2 the interior wall portion 70 of the top housing is spaced closely to the transfer roll 22 with no more than 0.080 of an inch clearance. An interior discontinuity 72 in wall surface 70 provides an opening for the transfer roll 22 to contact the ink roll 18. The limited exposure to the air of the transfer roll 22 provides a vapor escape route barrier for ink solvent evaporation from the saturated ink roll 18. The limited discontinuity 66 in the housing wall 68 and the close spacing between interior wall 70 of the housing 24 and roll 22 prevents evaporation of the volatile ink and dry out of ink roll 18 when not in use.

The second bore 74 in housing 24 receives a shaft 76 engaged to an adjustment knob 78. 0-ring 77 mounted on the bottom portion of the shaft 76 and DELRIN ® washers 71 and 73 above and below housing 24 provide an air tight seal in bore 74. A smaller diameter shaft 80 descending downwardly from shaft 76 engages with a bore 82 in the center of ink roll 18. The ink roll 18 turns on shaft 80 and the bottom 19 of roll 18 is spaced apart from the housing back 26. The ink roll 18 is enclosed entirely by housing 24.

A third threaded bore 84 is found in side wall 68 of the housing 24 and is used to thread an ink refill container 86 to housing 24. The ink flows by gravity into a ball type exit 88 which directly wets the ink roll 18 with ink on demand. This configuration is used for web printing. The bore 84 could be located adjacent bore 74 on a top surface of housing 24 for other types of printing.

A standard tension apparatus 90 mounted from base 12, commonly used on inking apparatus, supports the cartridge housing. The pressure of the transfer roll 22 on the letters 30 of the print drum 14 is controlled by position adjusting screw 91. The tension apparatus 90 is supported by an arm 92, pivotally mounted on base 12 at pivot point 94.

The inking apparatus 10 of this invention can be mounted to in line manufacturing equipment by a shaft 96 which can be clamped to the in line equipment at a proper height and distance to permit inking of the desired surfaces. Support housing 98 maintains alignment of shaft 96 in bore 100 within mounting base 12 as seen in FIG. 6.

Figure 5:
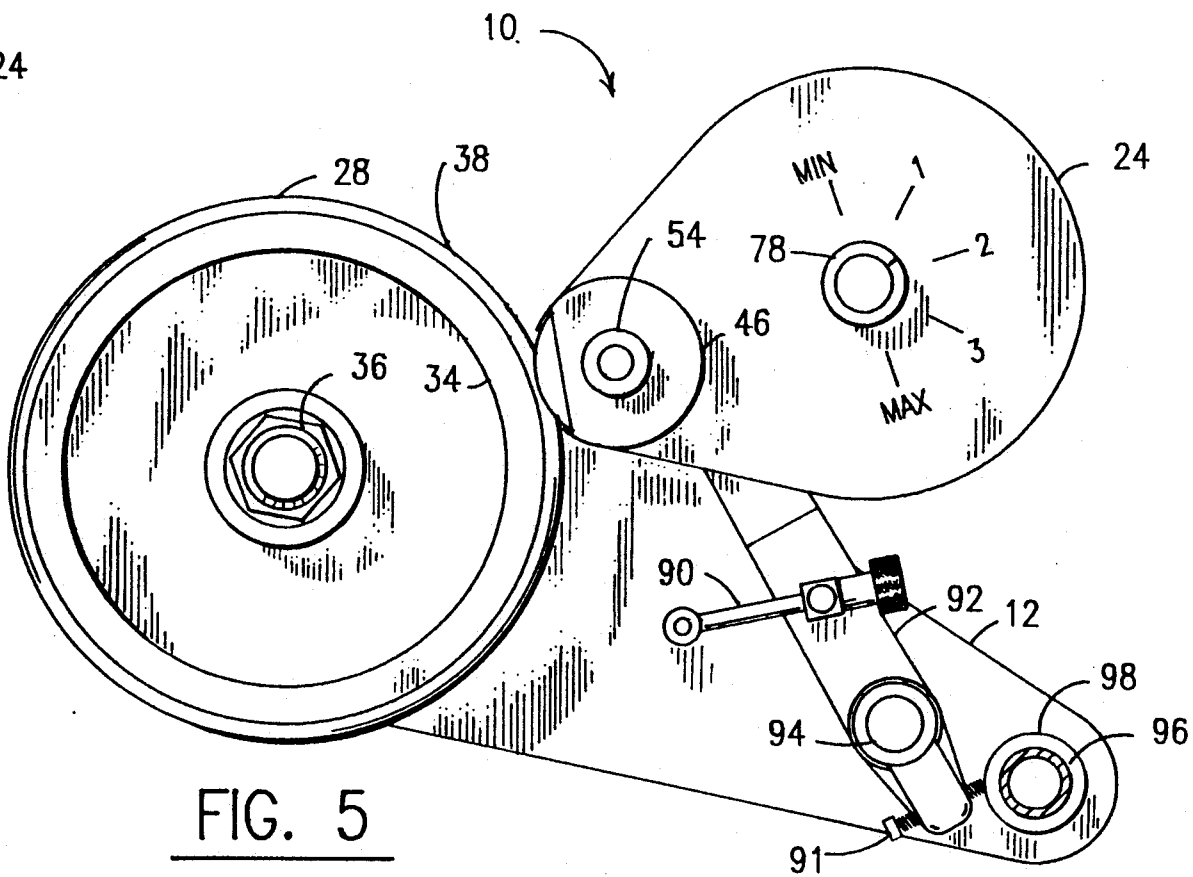
FIG. 5 is a top plan view of the cartridge housing.

The adjustment knob 78 as shown in FIG. 5 can have an indicator pointer on a top surface to match with a desired tension adjustment reading set forth on a top surface of housing 24. A clockwise turning of knob 78 increases the tension on ink roll 18 and causes a heavier flow of ink to the transfer roll 22.

Figure 6:
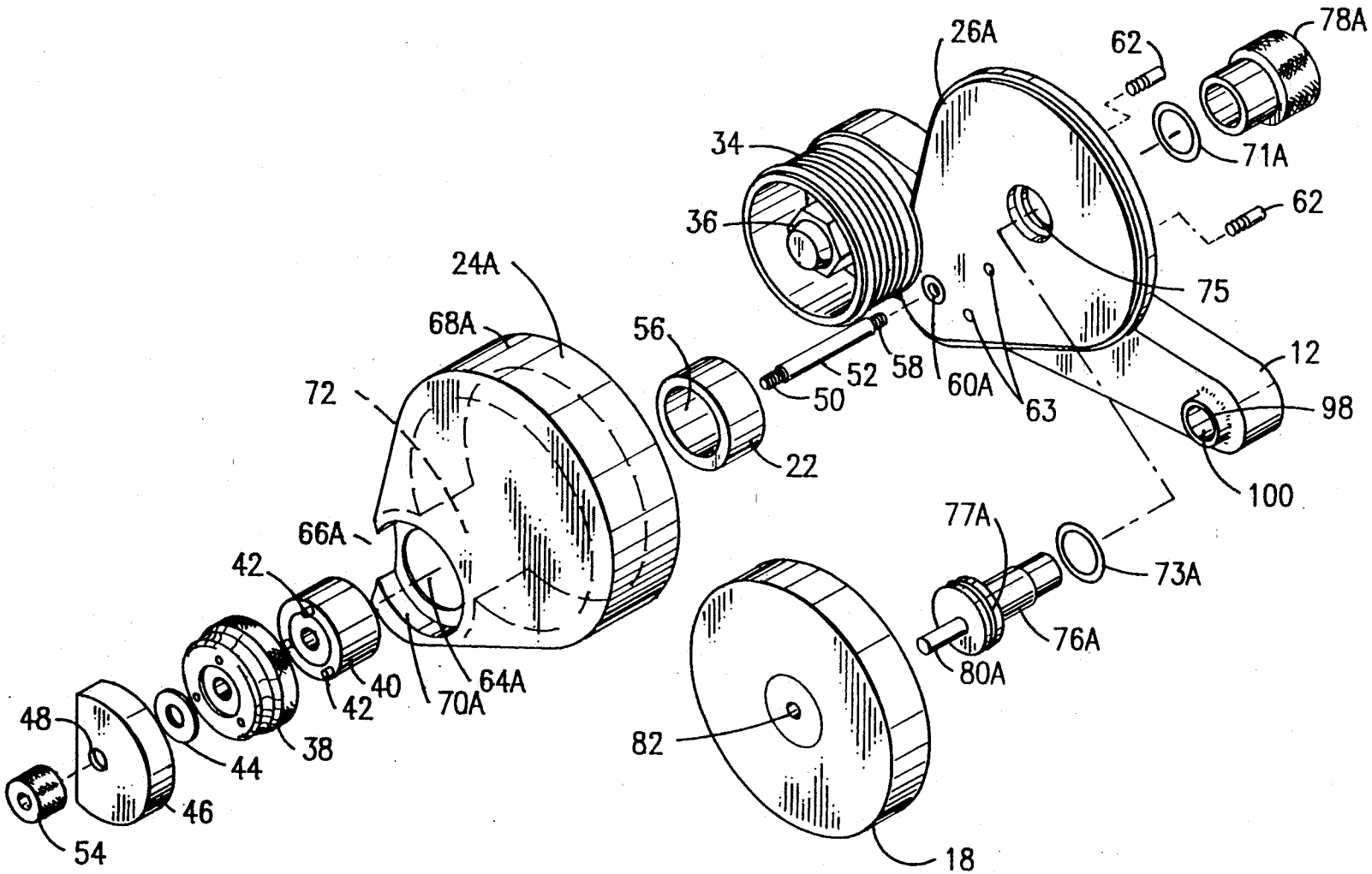
FIG. 6 is an exploded view of an alternative embodiment of the inking roll, transfer roll, print drum and cartridge housing .

In an alternative embodiment of the invention as seen in FIG. 6, the bottom ink housing 26A, rather than top ink housing 24A, contains a bore 75 for receipt of shaft 76A. The bottom portion of the adjustment knob 78A engages shaft 76A projecting through bore 75 with 0-ring seal 77A and washers 71A and 73A providing a gas tight seal.

Figure 4:
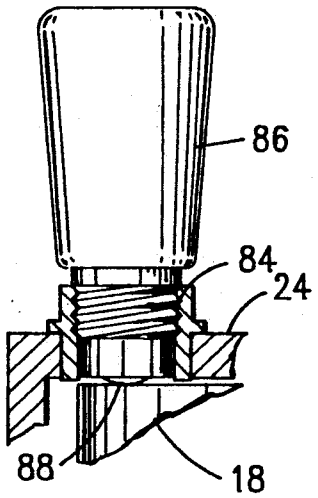
FIG. 4 is a partial sectional view of the connection of the ink refill container to the cartridge housing.

In the top housing 24A, the side wall 68A, the first bore 64A, the interior wall 70A and the wall discontinuity 66A remain substantially the same. There are no additional bores in housing 24A in this configuration. An outside ink supply such as shown in FIG. 4 can be added by making an additional bore in housing 26A. Tension between transfer roll surface 22 and dye surface 30 is adjusted by loosening screws 62 and sliding base 26A forward and securing screws 62.

Figure 7:
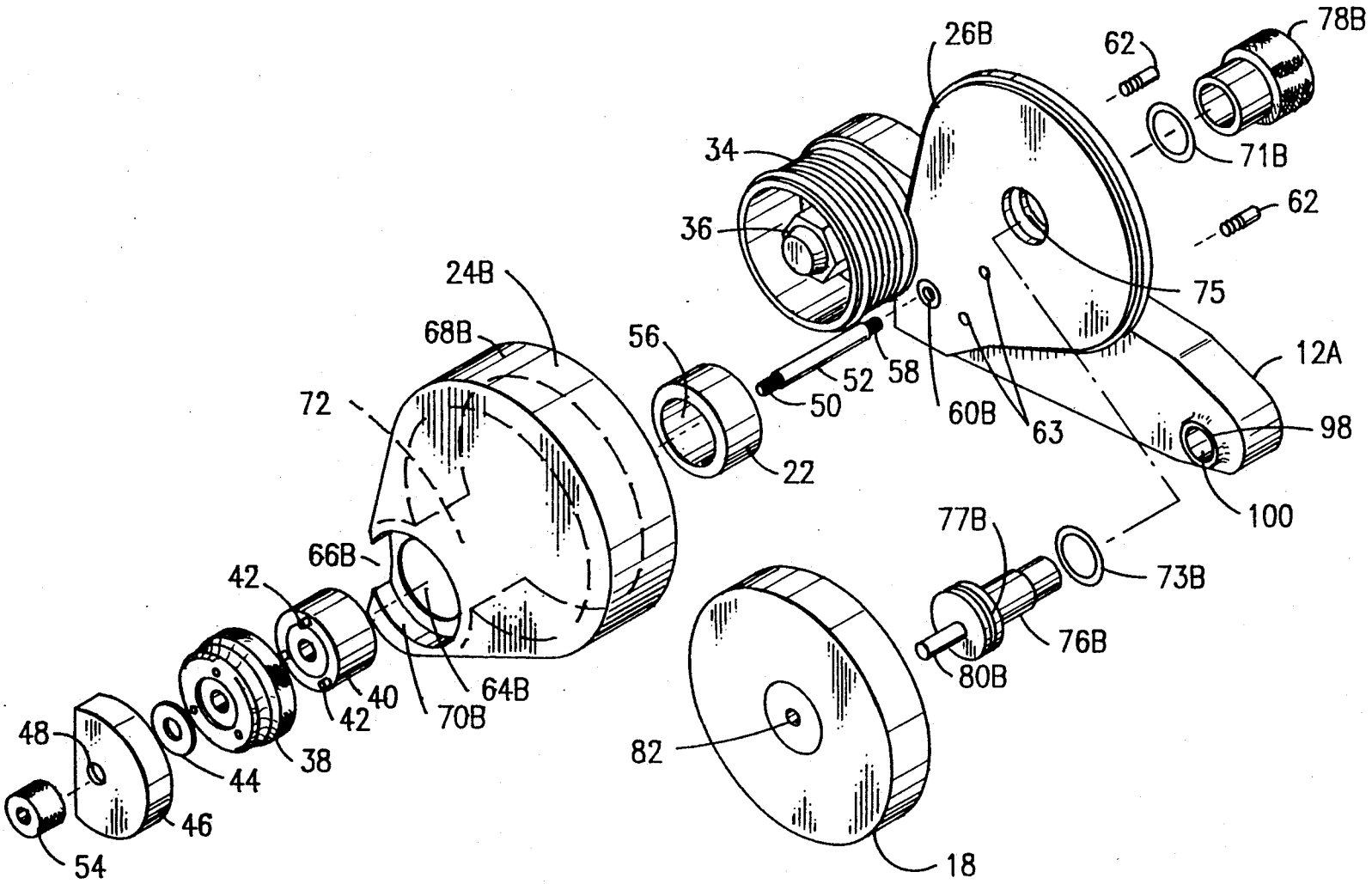
FIG. 7 is an exploded view of an alternative embodiment of the invention showing a variation in the base member and bottom housing contour.

In the alternative embodiment seen in FIG. 7 the base 12A and base housing 26B have a different configuration with 24B, 64B, 66B, 70A, 71B, 73B, 76B, 77B and 80B corresponding to the same elements in FIG. 6.

The ink used with the inking apparatus described above is a commercial grade of a fast drying volatile ink used for non-porous surfaces such as those on wax cartons. The ink roll is usually made from a reticulated neoprene foam and the transfer roll is made from "DELRIN" ®, a high strength plastic made by E. I. du Pont de Nemours & Company, Inc. The print drum covering is made from a natural rubber with the parallel ridges configured to hold letters or numbers press fit into place.

The spacing between the transfer roll 22 and the housing wall 70 or 70A is critical and should be in the range of 0.080 to 0.010 inches with about 0.030 inches being preferred. The discontinuity 66 and 66A in the wall 68 or 68A should be about three quarters of an inch. The ink roll 18 is mounted eccentric to knob 78 and usually 0.062 inch from the axial center of housing 24. The ink roll 18 is located in a generally annular portion of the housing 24 or 26. The transfer roll 22 is located within a lateral projection from an axial centerline of the annular portion of the housing 24. The drive mechanism from the print drum to the drive roll is activated by friction to coincide with boxes or web materials moving along a conveyor line or web line in a manufacturing process.

Optionally, a neoprene seal can be inserted between the top housing 24 or 24A and the bottom housing 26 or 26A. Such a seal will enhance retention of the volatile inks within the cartridge formed by the housing 24/26, 24A/26A or 24B/26B.

Equivalent equipment can be substituted for the equipment set forth above to achieve the results set forth above in the same manner.

Having thus described the invention, what is claimed and desired to be secured by Letters Patent is:

1. A cartridge assembly for an ink filled roll and an abutting transfer roll comprising a first housing member tightly fitted to a second housing member to form an enclosure for the ink filled roll and the transfer roll, corresponding portions of the first and second housing members having a generally annular configuration enclosing the ink filled roll with a first bore axially located within the annular configuration of either the first or second housing member to accommodate a shaft around which the ink filled roll rotates within the first and second housing member enclosure, corresponding portions of the first and second housing members having a lateral outwardly projecting portion with respect to the axis of the first bore in the first or second housing members, the projecting portion of the first housing member having an inner wall enclosing and closely spaced from an outer circumference of the transfer roll rotatably located within the projecting portion of the first housing member, a drive roll rotatably located exterior to the projecting portion of the first housing member and axially aligned with the transfer roll, the transfer roll rotating in response to the rotation of the drive roll, a discontinuity in an exterior side wall of the projecting portion of the first housing member adjacent to the transfer roll and distal from the ink roll to permit exposure of less than 90 degrees of the transfer roll circumference, a discontinuity in an interior side wall of the first housing member distal from the discontinuity in the exterior side wall to permit abutment of the transfer roll and ink filled roll within the housing enclosure, and the drive roll turning in response to contact with a moving print roll drum.

2. The cartridge assembly according to claim 1 wherein the first bore is located through a top surface wall of the first housing member.

3. The cartridge assembly according to claim 1 wherein the first bore is located through a base surface wall of the second housing member.

4. The cartridge assembly according to claim 1 including a hub located within the center of the transfer roll, the hub being turned by the drive roll, a second bore disposed in a top surface of the first housing member within the projecting portion, the transfer roll being located in the second bore.

5. The cartridge assembly according to claim 4 including a stud threaded at a first and a second end, the first end threaded to the second housing member, the stud positioned through the second bore in the first housing member and through a center point in the transfer roll and drive roll, the second end of the stud connected to a threaded knob exterior to the drive roll.

6. The cartridge assembly according to claim 5 including a rail annularly positioned around a print drum, the print drum having a print surface in abutting contact with the portion of the transfer roll exposed at the exterior wall discontinuity, the drive roll turning in response to frictional contact with the rail.

7. The cartridge assembly according to claim 4 including an ink source container to provide an on demand flow of ink to the ink roll, the ink source container having external threads is a base portion engaging threads within a third bore located in the first housing member.

8. The cartridge assembly according to claim 1 including a base member supporting the print drum, a tension apparatus with a tension adjustment means mounted on the base member and controlling the amount of pressure extended by the transfer roll on a print surface of the print drum.

9. The cartridge assembly according to claim 1 including a base member, the print drum axially mounted on the base member and a tension assembly arm attached to the base member supporting the two housing members.

10. The cartridge assembly according to claim 1 wherein the spacing between the outer circumference of the transfer roll and the inner wall of the projecting portion of the first housing member is 0.080 to 0.010 inches.

11. The cartridge assembly according to claim 10 wherein the spacing is about 0.030 inches.

12. An inking apparatus comprising, a base member supporting a print drum on a vertical shaft, a tension apparatus mounted on an arm pivotably supported on the base member, a cartridge assembly enclosing an ink filled roll and an abutting transfer roll, the transfer roll mounted on the arm, the cartridge assembly having a first housing member tightly fitted to a second housing member to form the enclosure for the ink filled roll and the transfer roll, corresponding portions of the first and second housing members having a generally annular configuration enclosing the ink filled roll with a first bore axially located within the annular configuration of either the first or second housing member to accommodate a shaft rotatably supporting the ink filled roll within the cartridge assembly, corresponding lateral projecting portions of the first and second housing members adjacent the annular configuration, the projecting portion of the first housing member containing an inner wall closely spaced from an outer circumference of the transfer roll rotatably located within the first housing member, a drive roll located exterior to the first housing member and axially aligned with the transfer roll, the transfer roll rotating in response to rotation of the drive roll, a discontinuity in an exterior side wall of the first housing member adjacent to the transfer roll and distal from the ink filled roll to permit exposure of less than 90 degrees of the transfer roll circumference, a discontinuity in an interior side wall of the first housing member distal from the discontinuity in the exterior side wall to permit abutment of the transfer roll and the ink filled roll within the housing enclosure, and the drive roll turning in response to contact with the print drum in a moving mode.

13. The inking apparatus according to claim 12 wherein in the cartridge assembly, the first bore is located in a top surface wall of the first housing member.

14. The inking apparatus according to claim 12 wherein in the cartridge assembly, the first bore is located through a base surface wall of the second housing member.

15. The inking apparatus according to claim 12 including a hub located within a center of the transfer roll, the transfer roll being located below a second bore in a top surface of the first housing member within the lateral projecting portion of the top housing, the hub being turned by the drive roll.

16. The inking apparatus according to claim 15 including a stud threaded at a first and second end connecting at the first end to the second housing member, the stud positioned through the second bore in the first housing member and through a center point in the transfer roll and drive roll, the stud at the second end connected to a threaded knob exterior to the drive roll.

17. The inking apparatus according to claim 16 including a rail annularly positioned around the print drum, the print drum having a print surface in abutting contact with the portion of the transfer roll exposed at the exterior wall discontinuity, the drive roll turning in response to frictional contact with the rail.

18. The inking apparatus according to claim 12 including an ink reservoir connecting to the first housing member through a threaded hole adjacent to the ink roll.

19. The inking apparatus according to claim 12 including an ink reservoir connecting to the second housing member through a threaded hole adjacent to the ink roll.

20. The inking apparatus according to claim 12 including a bore in the base member distal from the shaft supporting the print drum, the bore containing a mounting shaft, the mounting shaft being connected to a manufacturing feed line containing boxes or web surfaces to be printed by the cartridge assembly.

21. The inking apparatus according to claim 12 wherein the spacing between the outer circumference of the transfer roll and the inner wall of the projecting portion of the first housing member is 0.080 to 0.010 inches.

22. The inking apparatus according to claim 21 wherein the spacing is about 0.030 inches.

* * * * *